United States Patent [19]

Roovers

[11] Patent Number: 4,578,931

[45] Date of Patent: Apr. 1, 1986

[54] APPARATUS FOR PRODUCING POUCH PACKAGES

[75] Inventor: Gijsbertus Roovers, Eindhoven, Netherlands

[73] Assignee: Robert Bosch GmbH, Stuttgart, Fed. Rep. of Germany

[21] Appl. No.: 364,140

[22] Filed: Mar. 31, 1982

[30] Foreign Application Priority Data

Apr. 4, 1981 [DE] Fed. Rep. of Germany ..... 3113634

[51] Int. Cl.[4] ..... B65B 9/10; B65B 41/12

[52] U.S. Cl. ..... 53/551; 53/389

[58] Field of Search ..... 53/551, 552, 389, 64, 53/550, 66

[56] References Cited

U.S. PATENT DOCUMENTS 3,355,166 11/1967 Plumb ..... 53/389 X
3,367,221 2/1968 Schmermund ..... 53/389 X
4,118,913 10/1978 Putnam, Jr. et al. ..... 53/551
4,136,505 1/1979 Putnam, Jr. et al. ..... 53/551
4,288,965 9/1981 James ..... 53/551 X

*Primary Examiner*—Horace M. Culver
*Attorney, Agent, or Firm*—Edwin E. Greigg

[57] ABSTRACT

An apparatus for producing tubular-pouch packages is proposed, which has a pair of endless conveyor belts subjected to underpressure in order to intermittently advance the tube. In order to attain a simple structure and low wear on the part of the tube-advancing device, the conveyor belts advancing the tube are driven continuously, and the underpressure exerted through these belts and effecting frictional engagement between the conveyor belts and the tube is intermittently controlled. A brake for the packaging material, which also works by means of underpressure, is associated with the arriving web of packaging material and is alternatively exposed to underpressure or to atmospheric pressure with the suction devices of the conveyor belts.

2 Claims, 1 Drawing Figure

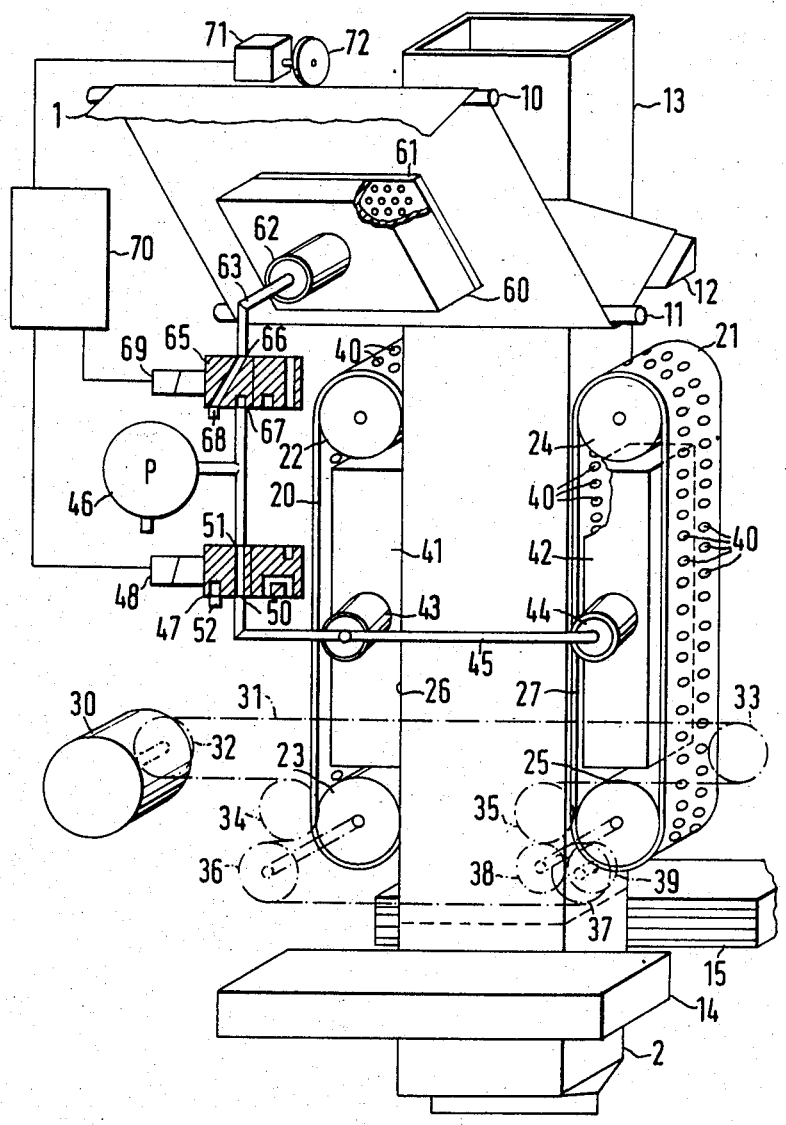
71
72
1
10
13
61
62
70
63
60
12
11
69
65
66
40
21
68
67
22
24
P
46
20
40
51
41
42
40
48
47
52
50
43
44
45
30
31
26
27
33
32
23
25
34
35
36
38
39
37
15
14
2

APPARATUS FOR PRODUCING POUCH PACKAGES

BACKGROUND OF THE INVENTION

The invention is based on an apparatus for producing tubular-pouch packages as generally described herein. In an apparatus known from German Offenlegungsschift No. 25 11 937, the two conveyor belts against which the tube is pressed as the result of underpressure are driven intermittently. In practice, a continuously running electromotor and an electromagnetic coupling are used to effect this intermittent drive of the conveyor belts; the electromagnetic coupling, controlled by a clock transducer, is engaged at the beginning of each forward movement, and at the end of each forward movement it is aerated by a means controlled by a photo cell scanning a printed marking on the packaging material or by a travel measuring device.

In order to prevent continued movement beyond what is intended, the coupling may have a brake associated with it which engages when the coupling is aerated. Because of the high frequency of indexing—from 60 to 100 indexing movements per minute—the coupling and the brake are subjected to heavy wear, and the parts subject to friction must accordingly be changed frequently.

OBJECT AND SUMMARY OF THE INVENTION

The apparatus according to the invention has the advantage that except for the tube there are no driven masses to be accelerated and then braked again, so the drive motor output can be small. Furthermore, there is increased precision in the length drawn out upon indexing because of this absence of the driven masses to be accelerated and braked.

Advantageous further embodiments of and improvements to the apparatus disclosed can be attained by means of the characteristics disclosed herein. In producing heavy packages, it is of particular advantage that a suction device acting as a brake is disposed on the conveyor path of the strip of packaging material. This suction device is connected to the source of underpressure alternately with the suction devices for the conveyor belts, so that at the onset of the interval between indexing movements this suction device slows down the strip of packaging material or the tube and stops it.

The invention will be better understood and further objects and advantages thereof will become more apparent from the ensuing detailed description of a preferred embodiment taken in conjunction with the drawing

BRIEF DESCRIPTION OF THE DRAWING

The single FIGURE of the drawing shows an exemplary embodiment of the invention in a simplified perspective view of an apparatus for producing tubular-pouch packages.

DESCRIPTION OF THE PREFERRED EMBODIMENT

A strip of packaging material 1 being unwound from a supply roll (not shown) is guided over diversion rollers 10, 11 and a shaping shoulder 12, which shapes the strip around a shaping and filling tube 13 to form a tube 2, the overlapping edges of which are welded together. After a portion of the product to be packaged is placed into the tube 2 by the filling tube 13, a pair of transverse heatsealing jaws 14, 15 separates the tube 2 into indivudual tubular packages.

The forward movement of the tube 2 by one package length at a time is effected by a pair of conveyor belts 20, 21. The two endless conveyor belts 20, 21 are guided at either side of the filling tube 13 over two pairs of diversion rollers 22, 23 and 24, 25, one pair for each conveyor belt, such that of the parallel segments of the belts located between the diversion rollers, the two facing segments 26, 27 of the two belts extend at a slight distance from the narrow sides of the filling tube 13, which has a rectangular cross section. The endless conveyor belts 20, 21 having parallel flights and are continuously driven by an electromotor 30 via a toothed belt 31, which is guided over diversion wheels 32-37, of which one wheel 36 is connected with the lower diversion roller 23 of the first conveyor belt 20 and the other wheel 37, via a gear-wheel mechanism 38, 39, drives the diversion roller 25 of the other conveyor belt.

In order to create frictional engagement between the exterior of the tube 2 and the segments 26, 27 of the two endless conveyor belts 20, 21 contacting it in order to advance the tube 2, the conveyor belts 20, 21 have holes 40, and their segments 26, 27 contacting the tube 2 pass before suction boxes 41, 42, which are open toward the segments 26, 27. With its open side, one suction box 41, 42 substantially covers the free surface area of one segment 26, 27 of one conveyor belt 20, 21. The suction boxes 41, 42 are connected with a vacuum pump 46 via connector fittings 43, 44 and a line 45.

In order to create an underpressure in the suction boxes 41, 42 by means of which the tube 2 is drawn firmly against the adjacent conveyor belts 20, 21 and in order to aerate the suction boxes 41, 42 so as to release the frictional engagement, a reversible 3/2-way valve 47 is incorporated in the line 45 and is actuatable by an electromagnet 48. The 3/2-way valve 47 has one connection 50 for the suction boxes 41, 42, one connection 51 for the vacuum pump 46 and one connection 52 discharging into the open. In one position, this valve 47 connects the suction boxes 41, 42 with the vacuum pump 46 and blocks the connection 52; in the other position, this valve blocks the connection 51 to the vacuum pump 46 and connects the suction boxes 41, 42 with the atmosphere.

An interval between advancing movements is required, in which a portion of the product to be packaged is poured into the open end at the top of the tube 2, a tubular package is marked off from the tube 2 by pressing the tube flat in a narrow zone and creating a top and bottom seam by means of the pair of transverse heat-sealing jaws 14, 15, and then one tubular package is finally severed from the tube. In order to effect rapid braking and stoppage of the strip of packaging material 1 and the tube 2 so as to bring about such an interval, a stationary suction box 60 is associated with the arrival seqment of the strip of packaging material 1 located between the two diversions rollers 10, 11. The suction box 60 has a perforated bottom plate 61 toward the arrival segment, and on the opposite side it has a connector fitting 62, which likewise communicates with the vacuum source 46 via a line 63. In order to control the underpressure or to aerate the suction box 60, a second 3/2-way valve 65 is incorporated in the line 63, having a connection 66 to the suction box 60, a connection 67 to the vacuum pump 46 and a connection 68 discharging into the open. In the first illustrated position, this valve connects the suction box 60 with the atmosphere and blocks the connection 67; in the other position, this valve connects the suction box 60 with the vacuum pump 46 and blocks the connection 68 with the atmosphere. The 3/2-way valve 65 is actuated by an electromagnet 69.

The two electromagnets 48 and 69 of the 3/2-way valves 47 and 65 for the suction boxes 41, 42 and 60 are controlled by a control device 70, which includes a clock transducer and is connected to a probe 71 which measures the travel path of the strip of packaging material 1. The probe 71 may have a measuring wheel 72 or a photo cell which responds to printed markings on the strip of packaging material 1. It is also possible for a time transducer to be provided instead of the probe.

In order to advance the tube 2 intermittently, the two 3/2-way valves 47, 65 are controlled by the control device 70 such that in order to initiate an advancement phase the first valve 47 connects the two suction boxes 41, 42 with the vacuum pump 46 and the other valve 65 aerates the suction box 60. As a result, the suction box 60, acting as a brake, releases the strip of packaging material 1 at one end and at the other end the underpressure in the suction boxes 41, 42 draws the tube 2 against the continuously moving endless conveyor belts 20, 21 and the tube 2 is carried along with the segments 26, 27 which are then moving downward. As soon as the desired length has been drawn off the supply roll, the probe 71 emits a signal to the control device 70, which now reverses the two magnets 48 and 69 of the valves 47 and 65 so that they cause the valves to assume the other position. In this position, which effects an interval in advancement, the suction box 60 is connected with the vacuum pump 46 and the suction boxes 41, 42 are aerated, so that the strip of packaging material 1 is braked and then held firmly, while the conveyer belts 20, 21 release the tube 2 and allow it to travel freely.

In the described exemplary embodiment, the suction box 60 acting as a brake has a suction face oriented toward the strip of packaging material and located in a single plane. In a modification of the suction box, a brake acting by means of underpressure could also be disposed on a diversion segment of the strip of packaging material, on the shaping shoulder or on the shaped tube. It is also possible for the apertures 40 in the conveyor belts 20, 21 to be disposed in only a single row or to be uniformly dispersed over the surface. Instead of only a single 3/2-way valve 47 for both suction boxes 41, 42, one valve may also be provided for each suction box.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for producing tubular packages, in which a web of packaging material is shaped into a tube then filled and divided along transverse seams into individual tubular packages, comprising two endless, perforated conveyor belts arranged in close proximity to portions of the tube for continuous operation to incrementally advance the tube by one package length at a time, said conveyor belts further include parallel portions oriented toward one another for movement in the same direction and for controlled engagement with portions of the tube, and first and second suction devices, one of said first and second suction devices positioned relative to each parallel portion of said conveyor belts, said first and second suction devices connected with a source of underpressure for attracting said tube toward said conveyor belt during operation of said first and second suction devices, a first valve device, said first and second suction devices connected by said first valve device to said source of underpressure, said first valve device arranged to establish a connection between said first and second suction devices and said source of underpressure only during the advancement phase of said tube whereby during advancement, said tube is attracted toward each of said conveyor belts by said first and second suction devices due to said source of underpressure and advanced thereby, a third suction device having a support surface over which said web is caused to travel, said third suction device arranged to be connected via a second valve device with said source of underpressure, and each of said first and second control devices are a 3/2-way valve controlled by a control means, said first control devices is connected to said first and second suction devices and said second control device is connected to said third suction device, wherein said first and second suction devices and said third suction device are connected alternatively with said source of underpressure or with atmospheric pressure.

2. An apparatus for producing tubular packages, in which a web of packaging material is shaped into a tube then filled and divided along transverse seams into individual tubular packages, comprising two endless, perforated conveyor belts arranged in close proximity to portions of the tube for continuous operation to incrementally advance the tube by one package length at a time, said conveyor belts further include parallel portions oriented toward one another for movement in the same direction and for controlled engagement with portions of the tube, and first and second suction devices, one of said first and second suction devices positioned relative to each parallel portion of said conveyor belts, said first and second suction devices connected with a source of underpressure for attracting said tube toward said conveyor belt during operation of said first and second suction devices, a first valve device, said first and second suction devices connected by said first valve device to said source of underpressure, said first valve device arranged to establish a connection between said first and second suction devices and said source of underpressure only during the advancement phase of said tube whereby during advancement, said tube is attracted toward each of said conveyor belts by said first and second suction devices due to said source of underpressure and advanced thereby, a third suction device having a support surface over which said web is caused to travel, said third suction device arranged to be connected via a second valve device with said source of underpressure, and each of said first and second valve devices are a 3/2-way valve with said first valve device having one connection to the underpressure device, one connection to said first and second suction devices and one connection discharging into the open for aerating said first and second suction devices and said second valve device has one connection to the underpressure device, one connection to said third suction device and one connection discharging into the open for aerating said third suction device.

* * * * *